US007719505B2

(12) United States Patent
Pai

(10) Patent No.: US 7,719,505 B2
(45) Date of Patent: May 18, 2010

(54) DISPLAY DEVICE AND DRIVING METHOD THEREOF

(75) Inventor: Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 546 days.

(21) Appl. No.: 11/755,003

(22) Filed: May 30, 2007

(65) Prior Publication Data

US 2008/0122766 A1 May 29, 2008

(30) Foreign Application Priority Data

Nov. 29, 2006 (TW) ..... 95144210 A

(51) Int. Cl.
*G09G 3/36* (2006.01)

(52) U.S. Cl. ..... 345/87; 345/98; 345/99; 345/100

(58) Field of Classification Search ..... 345/38, 345/50, 87, 90, 98, 99, 100, 204, 214; 348/671, 348/674, 793; 327/333; 326/62; 377/64
See application file for complete search history.

(56) References Cited

U.S. PATENT DOCUMENTS 6,853,372 B2 * 2/2005 Kanzaki et al. ..... 345/208
7,429,971 B2 * 9/2008 Park ..... 345/89

* cited by examiner

*Primary Examiner*—Abbas I Abdulselam
(74) *Attorney, Agent, or Firm*—Jianq Chyun IP Office

(57) ABSTRACT

A display device including data lines, scan lines, data driver, and scan driver is provided. An image signal output from the data driver has a plurality of data sections respectively corresponding to the data lines. Each predetermined number of image sections is defined as a group, and each group of image sections has a first and second reset data. The scan driver sequentially drives the scan lines of first group according to a first start waveform. The data driver writes the first group of data sections into display units on the scan lines of first group respectively. The scan driver drives the scan lines of first group according to a second start waveform after a predetermined period. The data driver writes the first reset data and the second reset data into the display units on a first portion and a second portion of scan lines respectively.

32 Claims, 14 Drawing Sheets

DISPLAY DEVICE AND DRIVING METHOD THEREOF

CROSS-REFERENCE TO RELATED APPLICATION

This application claims the priority benefit of Taiwan application serial no. 95144210, filed Nov. 29, 2006. All disclosure of the Taiwan application is incorporated herein by reference.

BACKGROUND OF THE INVENTION

1. Field of the Invention

The present invention relates to a driving method. More particularly, the present invention relates to a driving method for a display device.

2. Description of Related Art

Generally speaking, a liquid crystal display (LCD) device includes a display array structure, and each display unit in the display array has a thin film transistor (TFT). Images displayed by LCDs have high contrast and wide linear grayscale. Moreover, the LCDs have the advantages of square display, low power consumption, and low radiation, so users can enjoy an optimal visual environment. The development of the technology of LCD devices meets the users' requirement. According to the requirements of the users, the size of the LCDs is increased, so it has been an important topic to develop a large-size LCDs.

It is known that the LCD device is a hold type display, which is different from the impulse type display of a cathode ray tube display device. Referring to FIG. 1, the hold type display refers that a display unit remains in a same tone when a frame is displayed. Considering the operation of the circuit, when a frame F11 is displayed, a voltage of a storage capacitor in the display unit remains constant until the LCD device displays next frame F12. However, according to the characteristics of the hold type display, when dynamic images are displayed, a user obviously views blur edges even in an ideal condition (R/T=0) due to visual integration of human eyes.

Therefore, in the conventional LCD device, the hold type display realizes the impulse type display of dynamic images through impulse-driving. FIG. 2 is an architectural view of the system of a conventional impulse type display. As shown in FIG. 2, gate output enable (OE) signals are divided into two groups, and scan driving units 11-14 match with independent vertical start signals STV1-STV4 respectively, so as to insert a black level image data between any two image data. FIG. 3 is a timing diagram of the system of FIG. 2. As shown in FIG. 3, the writing of the image data and the writing of the black level data share the time of a same scan line (time division processing). Therefore, in case of high resolution and high frame rate, the charging will be insufficient, so the images cannot be displayed correctly.

SUMMARY OF THE INVENTION

The present invention is directed to a display device, which includes a plurality of data lines, a plurality of scan lines, a display array, a data driver, and a scan driver. The plurality of scan lines and the plurality of data lines are interlaced. The display array has a plurality of display units, and each of the display units corresponds to a set of data line and scan line interlaced with the data line. The data driver controls the plurality of data lines and output an image signal. The image signal has a plurality of image sections, and the plurality of image sections correspond to the plurality of scan lines respectively. The scan driver drives the plurality of scan lines. In the display device according to the present invention, each predetermined number of image sections is defined as a group, each group of the image sections has a first and a second reset data, and each group of scan lines is divided into a first and a second portions. The scan driver sequentially drives the scan lines of the first group according to a first start waveform, and the data driver writes the first group of image sections into the display units of the scan lines of the first group respectively through the data lines. After a predetermined period, the scan driver drives the first group of scan lines according to a second start waveform, and the data driver writes the first reset data into the display units on the scan lines of the first portion, and writes the second reset data into the display units on the scan lines of the second portion through the data lines.

The present invention is further directed to a driving method for a display device. The display device includes a plurality of data lines, a plurality of scan lines, and a plurality of display units corresponding to the data lines and the scan lines interlaced with the data lines. The driving method includes the following steps. An image input signal is received. The image input signal is divided into a plurality of image sections corresponding to the plurality of scan lines respectively. Each predetermined number of image sections is defined as a group. Each group of the scan lines is divided into a first second portion and a second portion. A first reset data and a second reset data are inserted into each group of image sections to generate an image data. The first group of scan lines is sequentially driven according to a first start waveform. The first group of image sections is written into the display units on the scan lines of the first group respectively through the data lines. The first group of scan lines is driven according to a second start waveform. The first reset data is written into the display units on the scan lines of a first portion through the data lines. And, the second reset data is written into the display units on the scan lines of a second portion through the data lines.

In order to make the aforementioned objectives, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
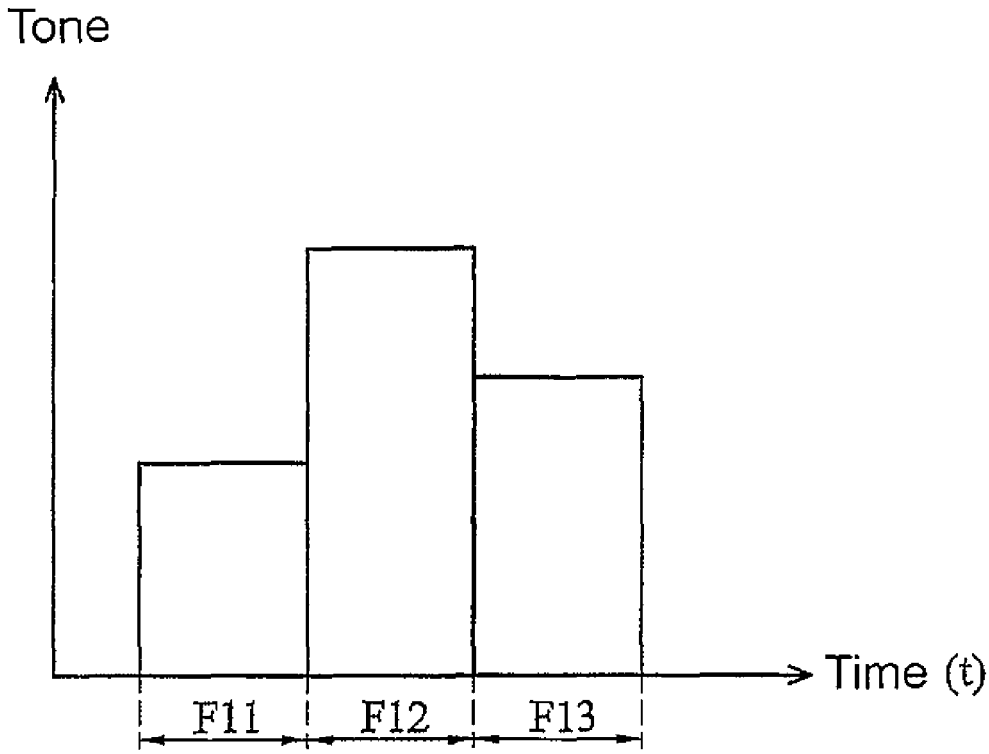
FIG. 1 (PRIOR ART)
FIG. 1 shows an LCD display device that drives the display unit by means of hold type driving.
Figure 2:
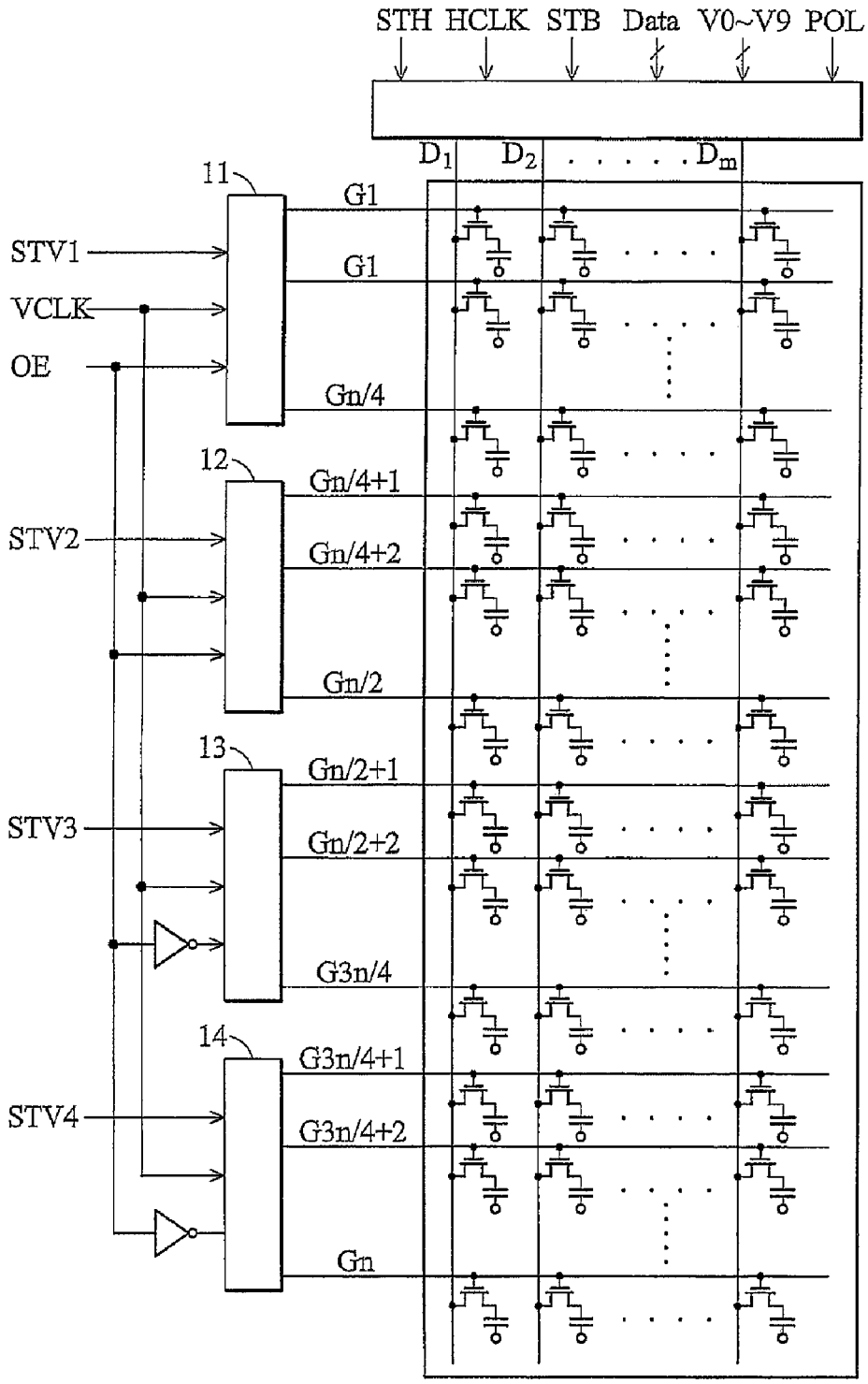
FIG. 2 (PRIOR ART)
FIG. 2 is an architectural view of the system simulating conventional impulse driving.
Figure 3:
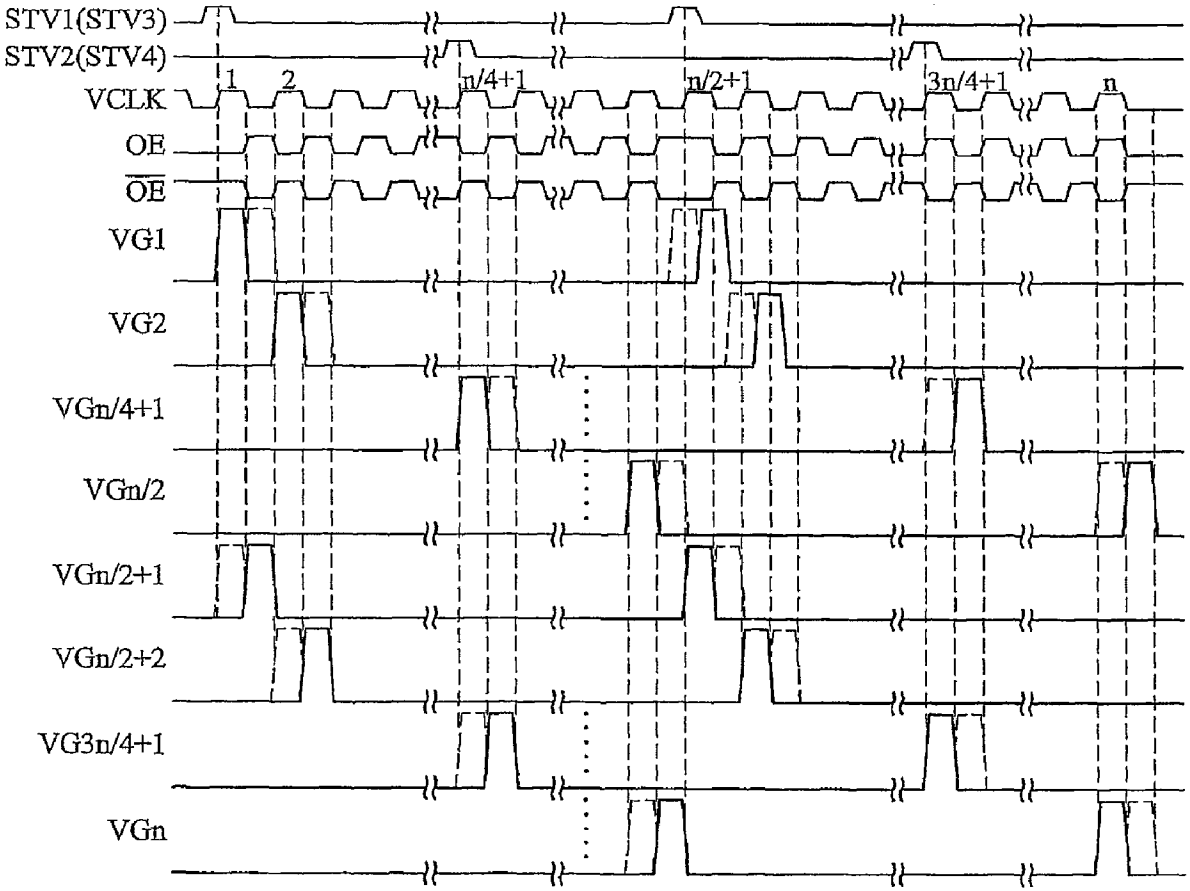
FIG. 3 (PRIOR ART)
FIG. 3 is a timing diagram of the system of FIG. 2.
Figure 4:
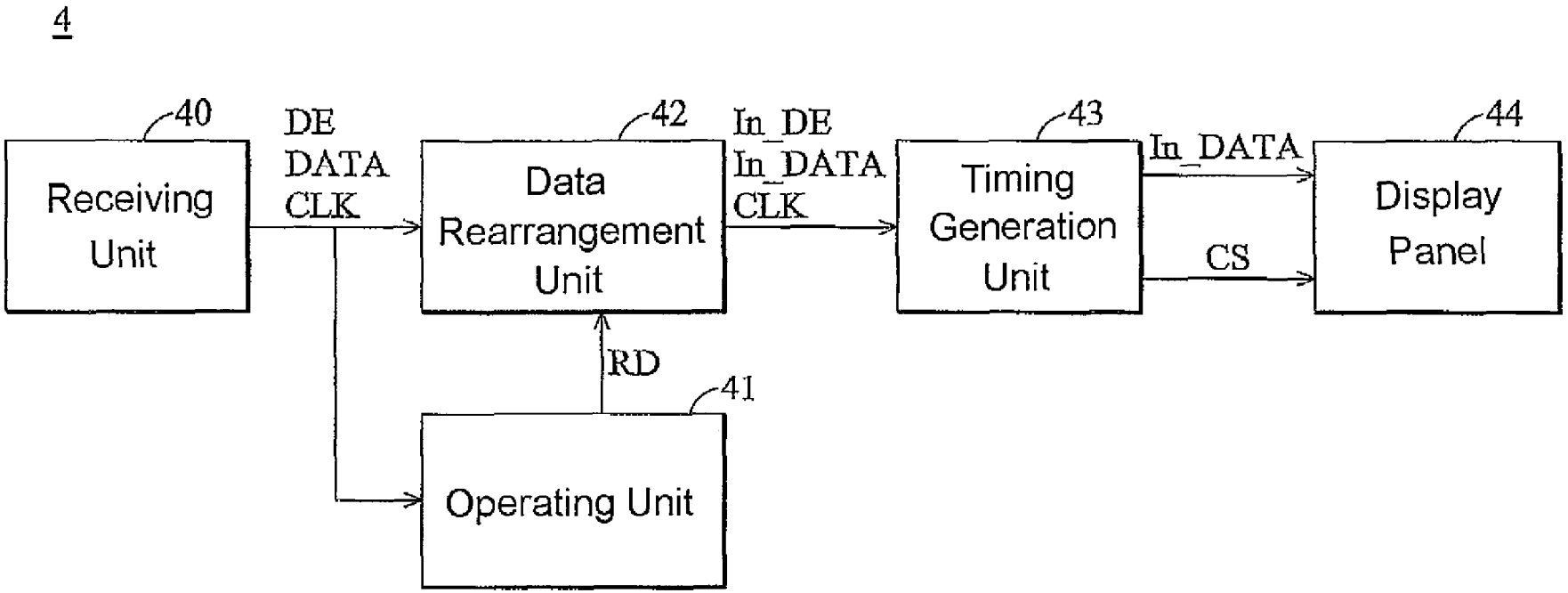
FIG. 4 is a schematic view of the display device according to a first embodiment of the present invention.
Figure 5:
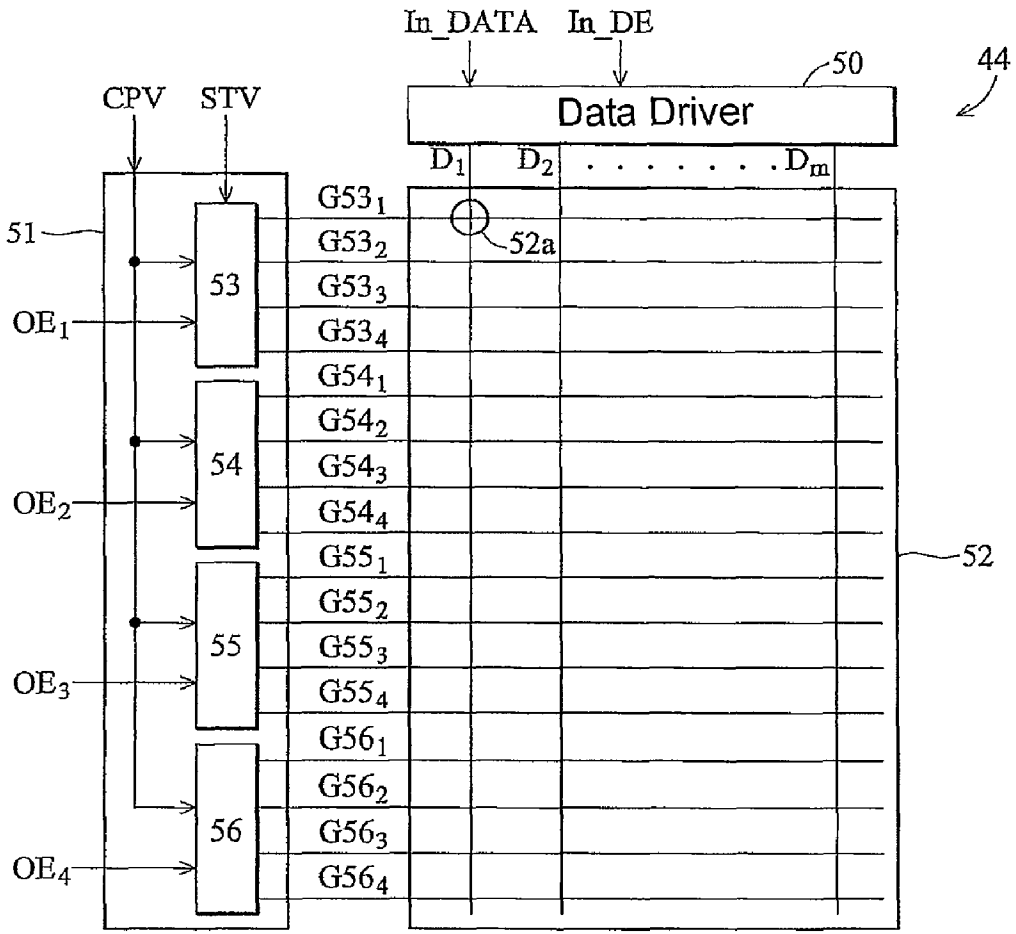
FIG. 5 is a schematic view of the display panel of the first embodiment.

FIG. 4 shows a display device according to a first embodiment of the present invention. Referring to FIG. 4, the display device 4 includes a receiving unit 40, an operating unit 41, a data rearrangement unit 42, a timing generation unit 43, and a display panel 44. Referring to FIG. 5, the display panel 44 further includes a data driver 50, a scan driver 51, and a display array 52. The data driver 50 controls data lines $D_1$-$D_m$. The scan driver 51 controls a plurality of scan lines, and has a plurality of driving units. The data lines $D_1$-$D_m$ are interlaced with all of the scan lines. The display array 52 has a plurality of display units, and each display unit correspond to the data line and the scan line interlaced with the data line, e.g., the data line $D_1$ and the scan line $G53_1$ correspond to the display unit 52*a*.

Referring to FIG. 4, the receiving unit 40 receives a data enable signal DE, an input image signal DATA, and a clock signal CLK from an external device. The operating unit 41 is coupled to the receiving unit 40, and generates a plurality of reset data RD according to the data enable signal DE, the input image signal DATA, and the clock signal CLK. The data rearrangement unit 42 is coupled to the receiving unit 40 and the operating unit 41, and receives the data enable signal DE, the input image signal DATA, the clock signal CLK, and the plurality of reset data RD. The reset data RD can be an all-black frame or an all-white image, or an image of any single grayscale. The data rearrangement unit 42 rearranges the input image signal DATA and the plurality of reset data RD, and the details will be described below.

The data rearrangement unit 42 divides the input image signal DATA into a plurality of image sections DS, and each image section DS correspond to a display unit on a scan line. In other words, the data of each image section DS is input into a display unit on one scan line. The data rearrangement unit 42 defines each predetermined number of image sections DS as one group, and a plurality of reset data RD is inserted into one group. After the input image signal DATA and the plurality of reset data RD are rearranged, the data rearrangement unit 42 generates an image signal In_DATA. In the first embodiment of the present invention, the operating unit 41 generates two reset data RD. The data rearrangement unit 42 defines four image sections DS as one group, and two reset data RD are inserted into one group. Herein, the reset data RD displaying all-black frames is taken as an example.

Figure 6:
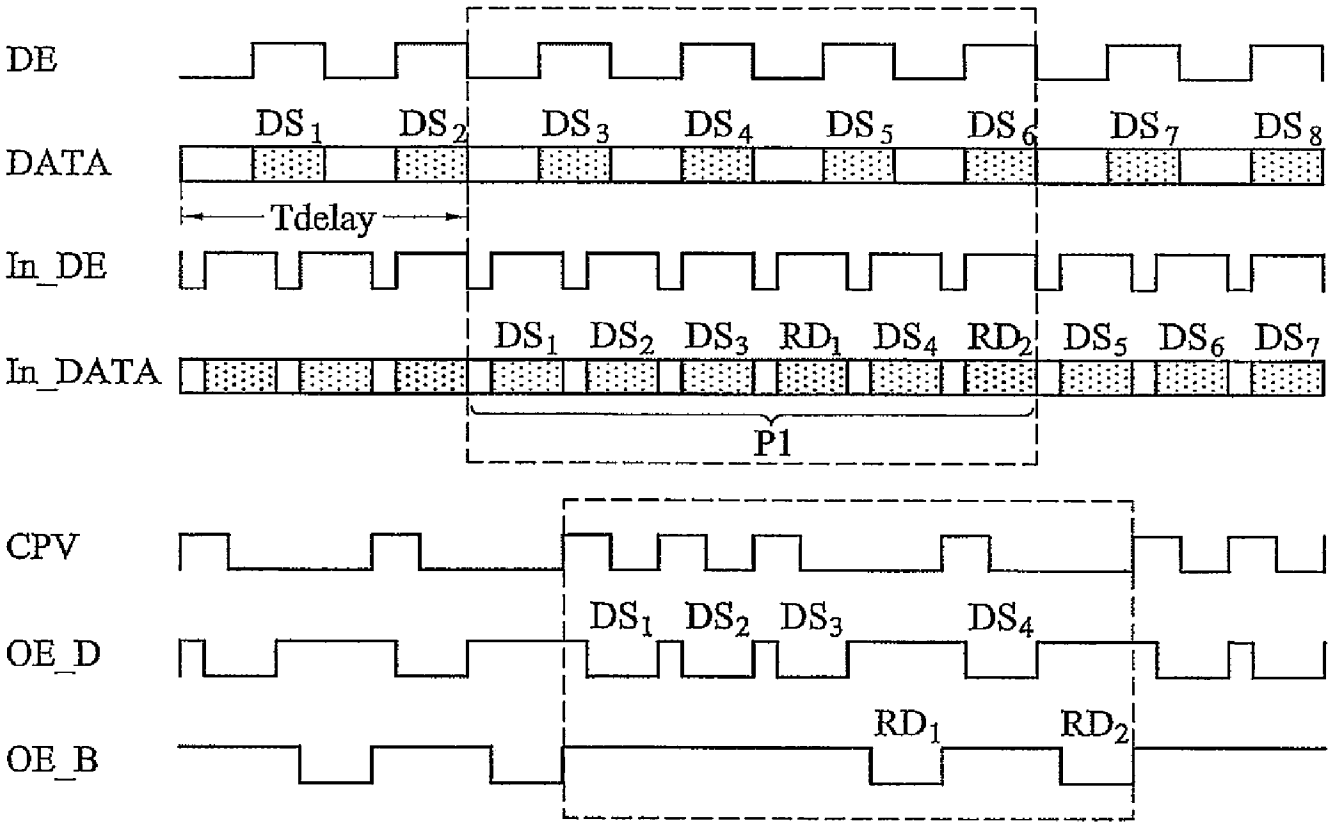
FIG. 6 shows a data processing cycle of the first embodiment of the present invention.

FIG. 6 shows a data processing cycle of the display device according to the first embodiment of the present invention. For example, referring to the input image signal DATA of FIG. 6, the image sections $DS_1$-$DS_4$ are defined as one group P1. Referring to the image signal In_DATA, two reset data $RD_1$ and $RD_2$ are inserted into the group P1, in which the reset data $RD_1$ is arranged between the image sections $DS_3$ and $DS_4$, and the reset data $RD_2$ is arranged subsequent to the image section $DS_4$. Moreover, as the data rearrangement unit 42 rearranges the input image signal DATA and the plurality of reset data RD, as compared with the input image data DATA, the image data In_DATA is delayed for a time Tdelay. Similarly, the data rearrangement unit 42 generates a delayed data enable signal In_DE.

In the first embodiment of FIG. 5, the scan driver 51 having four driving units 53-56 is taken as an example. As the data rearrangement unit 42 defines every four image sections DS as one group, in the first embodiment, each driving unit controlling four scan lines is taken as an example. As shown in FIG. 5, the driving unit 53 controls the scan lines $G53_1$-$G53_4$, the driving unit 54 controls the scan lines $G54_1$-$G54_4$, the driving unit 55 controls the scan lines $G55_1$-$G55_4$, and the driving unit 56 controls the scan lines $G56_1$-$G56_4$.

The timing generation unit 43 receives the image signal In_DATA, and generates a plurality of control signals CS according to the image signal In_DATA. The control signals CS at least include a gate timing signal CPV, a vertical start signal STV, and a plurality of output enable signals OE. The timing generation unit 43 transmits the image signal In_DATA and the data enable signal In_DE to the data driver 50, and transmits the gate timing signal CPV, the vertical start signal STV, and the plurality of output enable signals OE to the scan driver 51. It should be noted that in this embodiment, a group of scan lines is controlled by one driving unit of the scan driver 51, and the output enable signals OE of the driving units are independent from one another. In other words, as four driving units are taken as an example in the first embodiment, the timing generation unit 43 generates four independent output enable signals $OE_1$-$OE_4$, and transmits them to the driving units 53-56 respectively. Referring to FIG. 6, each output enable signal has two waveforms OE_D and OE_B. For example, when the output enable signal $OE_1$ has the image section enable waveform OE_D, the driving unit 53 allows the display units on the scan line $G53_1$-$G53_4$ of the group P1 to receive corresponding image sections $DS_1$-$DS_4$ respectively. When the output enable signal $OE_1$ has the reset data enable waveform OE_B, the driving unit 53 allows the display units on the scan line $G53_1$-$G53_4$ in the group P1 to receive corresponding reset data $RD_1$ and $RD_2$ respectively. In addition, referring to FIG. 5, the vertical start signal STV is sequentially provided to the driving units 53-56.

Figure 7A:
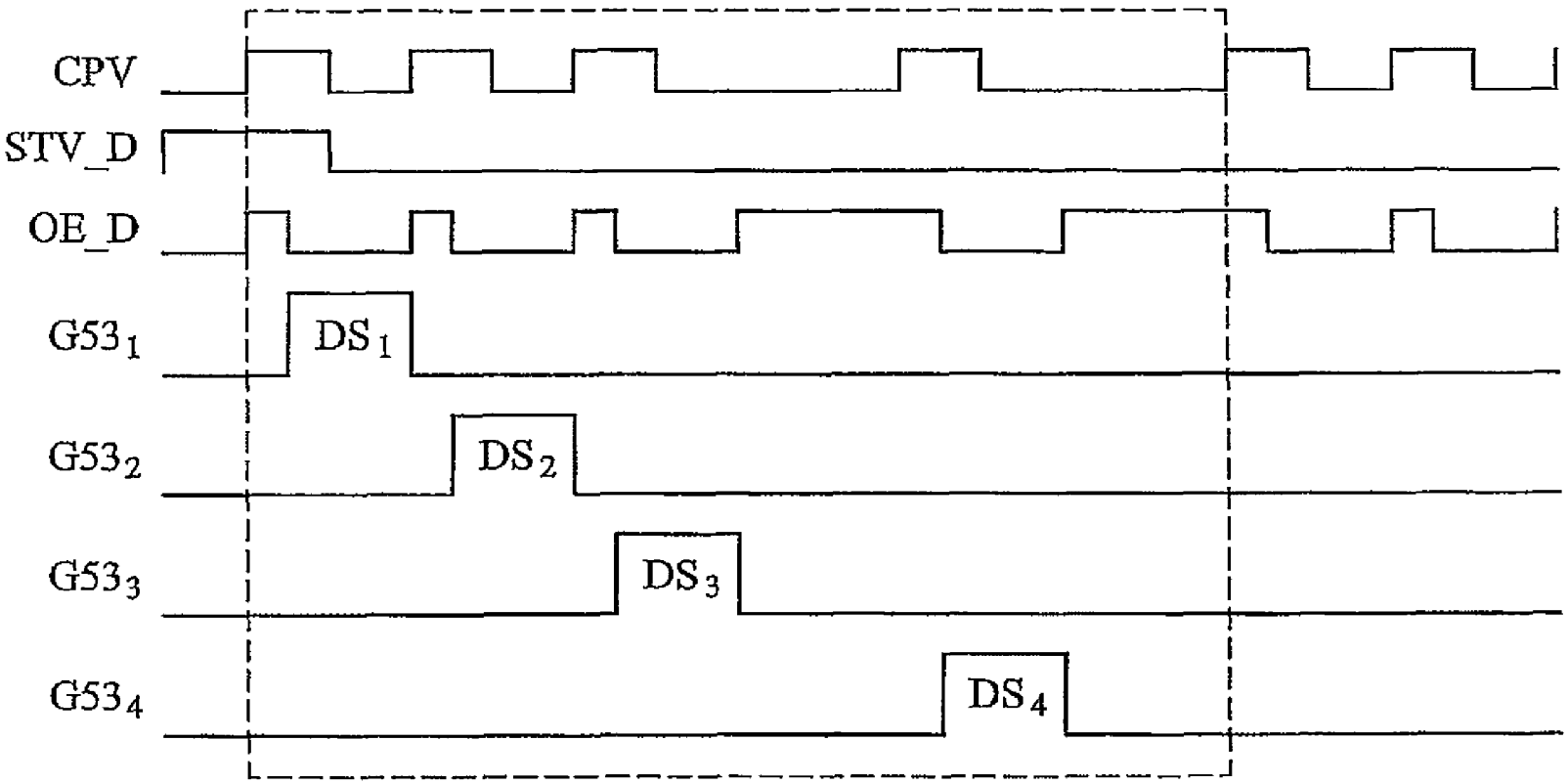
FIGS. 7*a* and 7*b* are driving timing diagrams of the scan lines according to the first embodiment of the present invention.
Figure 7B:
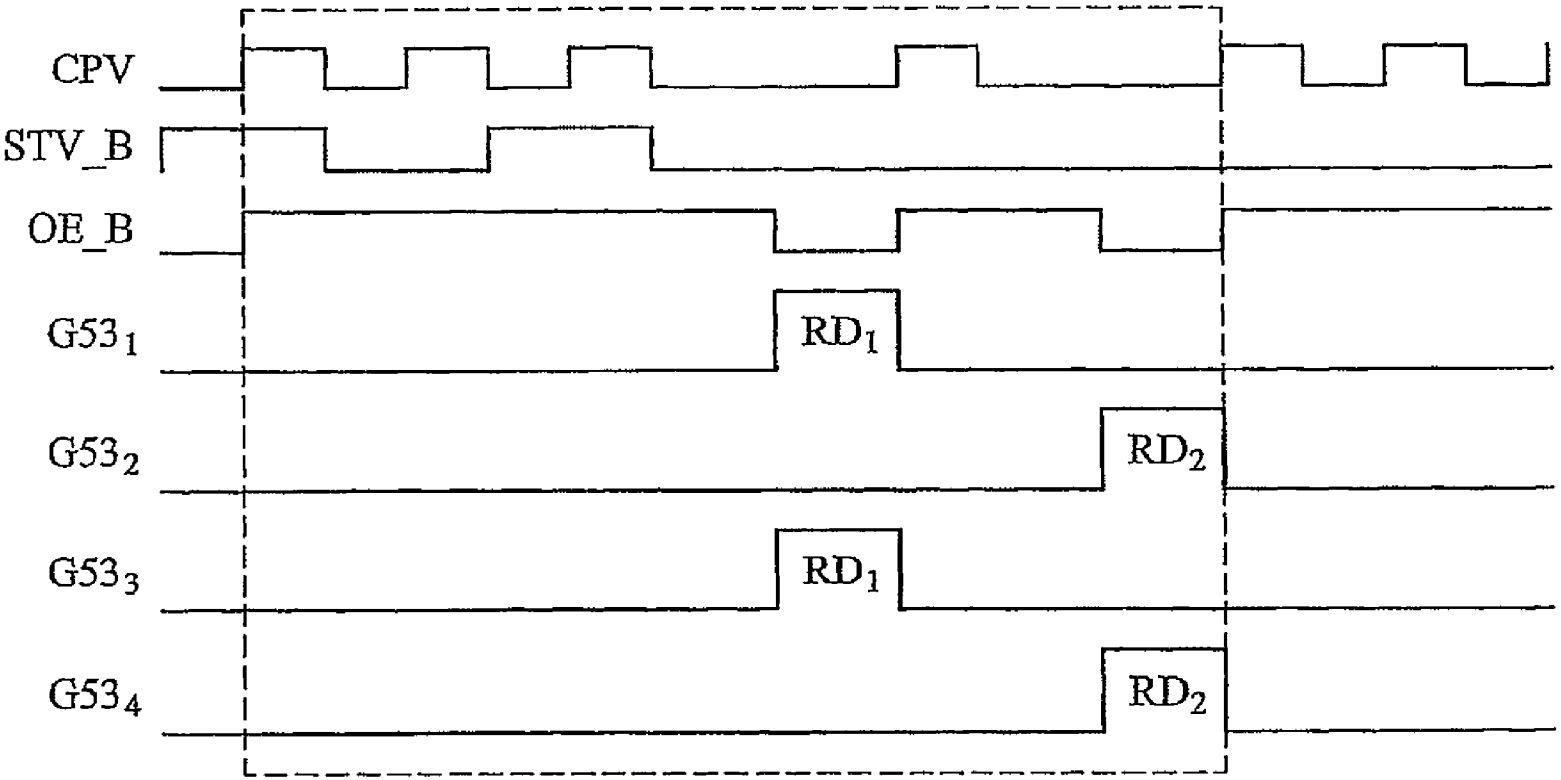

FIGS. 7*a* and 7*b* are driving timing diagrams of the scan lines according to the first embodiment of the present invention. The vertical start signal STV also has two waveforms STV_D and STV_B respectively indicating the start of writing the data section and the reset data. Referring to FIGS. 5 and 6, for example, the data sections $DS_1$-$DS_4$ belong to the group P1, and respectively correspond to the display units on the scan lines $G53_1$-$G53_4$. The all-black reset data $RD_1$ is inserted between the data sections $D_3$ and $D_4$, and the all-black reset data $RD_2$ is inserted subsequent to the data section $DS_4$. According to the first embodiment of the present invention, two reset data $RD_1$ and $RD_2$ are inserted in the group P1, so the group P1 of the scan lines $G53_1$-$G53_4$ is divided into a first portion and a second portion, so as to receive the reset data $RD_1$ and $RD_2$ respectively. In FIGS. 7*a* and 7*b*, the group P1 of scan lines $G53_1$-$G53_4$ and the control signals thereof are taken as an example. Referring to FIG. 7*a*, when the vertical start signal STV exhibits the image section start waveform STV_D, the driving unit 53 sequentially drives the scan lines $G53_1$-$G53_4$ according to the image section start waveform STV_D. After the driving unit 53 sequentially drives the scan lines $G53_1$-$G53_4$, the driving unit 54 sequentially drives the scan lines $G54_1$-$G54_4$ according to the data section start waveform STV_D, and the driving units 55 and 56 perform the same driving (not shown in FIG. 7*a*). When the scan lines $G53_1$-$G53_4$ are driven, the driving unit 53 allows the display units on the scan lines $G53_1$-$G53_4$ of the group P1 to receive corresponding image sections $DS_1$-$DS_4$ respectively according to the low level of the gate timing signal CPV and the image section enable waveform OE_D. It should be noted that as one black reset data is inserted into every four image sections in the image signal In_DATA, the image section enable waveform OE_D of each output enable signal OE remain at a high level for a relatively long time in portions corresponding to the black reset data $RD_1$ and $RD_2$, so as to shield the black reset data $RD_1$ and $RD_2$ from being loaded into the display units.

Referring to FIG. 7*b*, when the vertical start signal STV has the reset data start waveform STV_B, the driving unit 53 drives the scan lines $G53_1$ and $G53_3$ (the scan lines of the first portion of the group P1) at the same time according to the reset data start waveform STV_B, and then drives the scan line $G53_2$ and $G53_4$ (the scan lines of the second portion of the group P1) at the same time. When the driving unit 53 drives the scan lines $G53_1$-$G53_4$, the driving unit 54 drives the scan lines $G54_1$ and $G54_3$ at the same time according to the data section start waveform STV_B, and then drives the scan lines $G54_2$ and $G54_4$ at the same time. The driving units 55 and 56 perform the same driving (not shown in FIG. 7*b*). When the scan lines $G53_1$ and $G53_3$ are driven at the same time, the driving unit 53 allows the display units on the scan lines $G53_1$ and $G53_3$ of the group P1 to receive the reset data $RD_1$ at the same time according to a first low level of the reset data enable waveform OE_B. Then, when the scan lines $G53_2$ and $G53_4$ are driven at the same time, the driving unit 53 allows the display units on the scan lines $G53_2$ and $G53_4$ of the group P1 to receive the reset data $RD_2$ at the same time according to a second low level of the reset data enable waveform OE_B.

As the vertical start signal STV is sequentially provided to the driving units 53-56, subsequent to the driving unit 53, starting from the driving unit 54, the driving units 54-56 also indicate the start of writing the data section and the reset data respectively according to the waveforms STV_D and STV_B of the vertical start signal STV.

Figure 8:
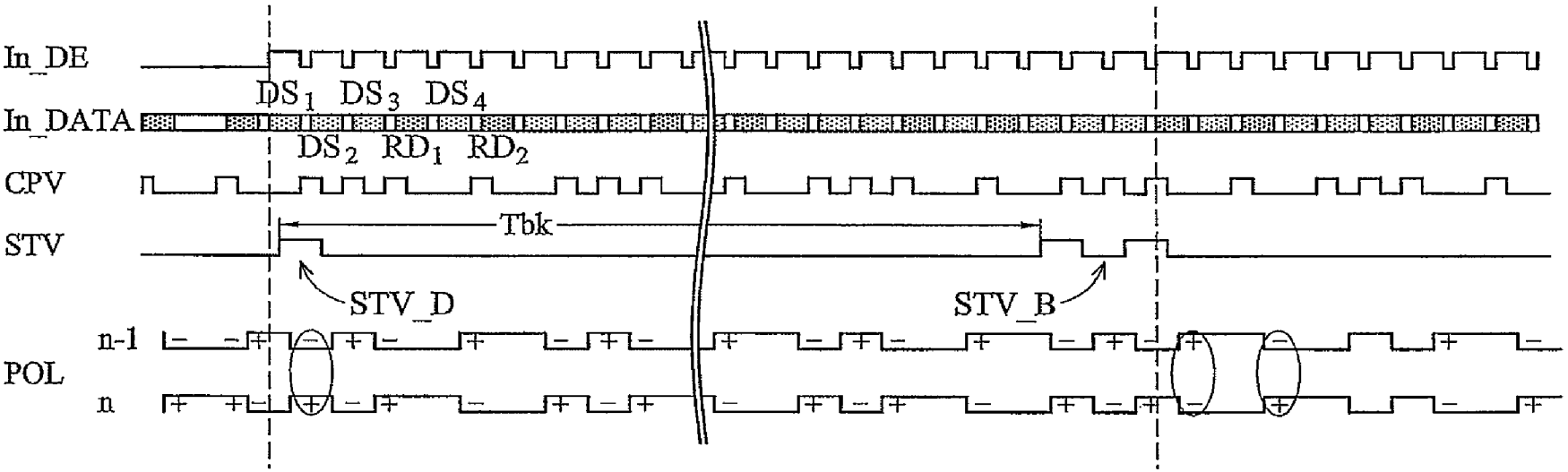
FIG. 8 is a schematic view illustrating polarities of the data according to the first embodiment of the present invention.

According to the first embodiment of the present invention, for a driving unit, the writing of the data section and the writing of the reset data are performed with a predetermined time interval. Referring to FIG. 8, the reset signal section start waveform STV_B appear after a predetermined period Tbk since the image section start waveform STV_D of the vertical start signal STV appears.

Referring to FIG. 8 again, the polarity change of the image sections and the reset data is also shown. Each frame has two time points of the polarity change. Referring to FIG. 8, in a $(N-1)^{th}$ frame, the polarities POL of the image sections are "−+−+− . . . " sequentially. When the image section start waveform STV_D of the vertical start signal STV appears, it indicates a start point of the image section of one frame, and the polarities of the image sections must be changed. Therefore, in an $N^{th}$ frame, when the image section start waveform STV_D appears, the polarities POL of the image sections are changed to "+−+− . . . " sequentially. Similarly, referring to FIG. 8, in the $(N-1)^{th}$ frame, the polarities POL of the reset data image sections are "+−+− . . . " sequentially. When the reset data start waveform STV_B of the vertical start signal STV appears, it indicates a start point of the reset data of one frame, and the polarities of the reset data must be changed. Therefore, in the $N^{th}$ frame, when the reset data start waveform STV_B appears, the polarities POL of the reset data are changed to "−+−+ . . . " sequentially. It is known that the polarities in each frame is changed twice at time points when the image section start waveform STV_D of the vertical start signal STV appears and when the reset data start waveform STV_B of the vertical start signal STV appears.

Figure 9:
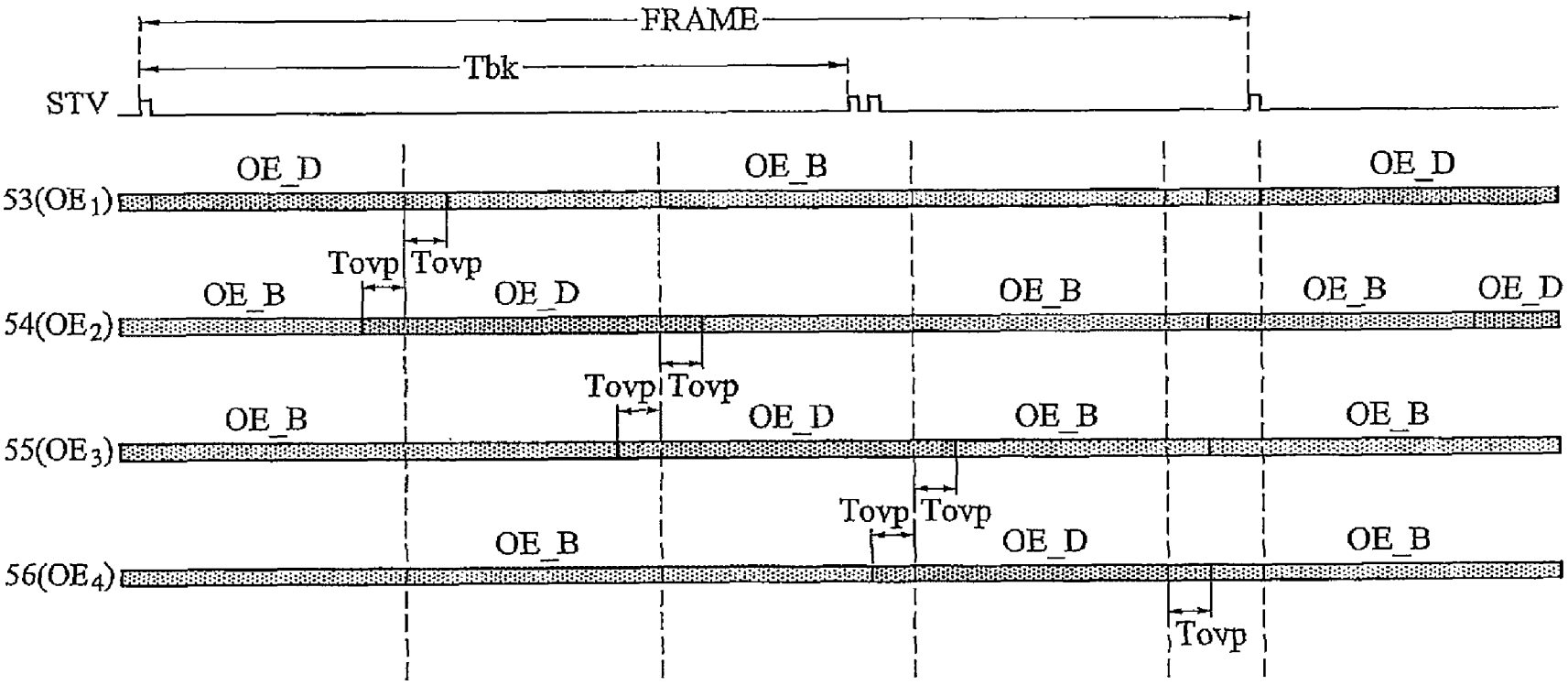
FIG. 9 is a schematic view of the control of the driving unit according to the present invention.

According to the first embodiment of FIG. 5, four driving units 53-56 are taken as an example. Output enable signals $OE_1$-$OE_4$ that are input to the driving units 53-56 are respectively independent from one another, and each output enable signal has an image section enable waveform OE_D and a reset data enable waveform OE_B. In some embodiments, the image section enable waveform OE_D can be designed to be partially overlapped between any two driving units, so as to facilitate the conversion between different waveforms, as shown in FIG. 9. For example, in a frame, the image section enable waveform OE_D of the output enable signal $OE_1$ and the image section enable waveform OE_D of the output enable signal $OE_2$ have an overlapped area Tovp between the driving units 53 and 54. Similarly, the image section enable waveform OE_D of the output enable signal $OE_2$ and the image section enable waveform OE_D of the output enable signal $OE_3$ have an overlapped area Tovp between the driving units 54 and 55, and the image section enable waveform OE_D of the output enable signal $OE_3$ and the image section enable waveform OE_D of the output enable signal $OE_4$ have an overlapped area Tovp between the driving units 55 and 56.

To sum up, the present invention defines a predetermined number of image sections as a group, and inserts an all-black or an all-white reset data, or a reset data of any single grayscale. Through the corresponding control signals such as the gate timing signal CPV, the vertical start signal STV, and the output enable signal OE, each display unit can display a black or all-white image or an image of any single grayscale after displaying normal images for a predetermined period, so as to simulate the impulse driving, thus preventing the overlapping of images of two adjacent frames and alleviating the phenomenon of blurred images.

Figure 10:
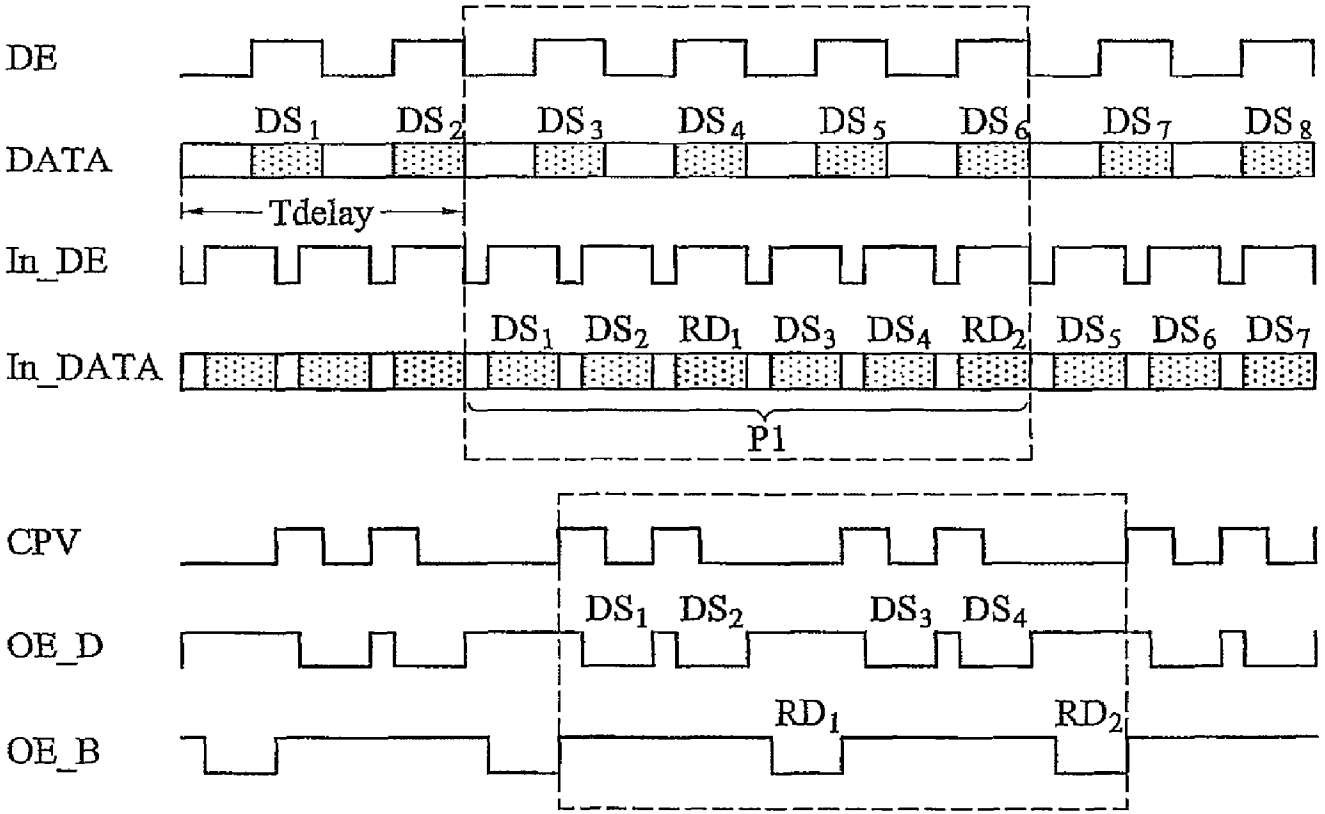
FIG. 10 shows the data processing cycle of a second embodiment of the present invention.

As described above, one data section DS is corresponding to display units on one scan line. Therefore, according to the polarities POL of FIG. 8, it is known that the scan driver 51 drives the scan lines through line inversion. In some embodiments, the scan driver 51 can drive the scan lines through other types of inversion, e.g., two-line inversion. FIG. 10 shows a data processing cycle of the display device according to a second embodiment of the present invention, in which the scan driver drives the scan lines through the two-line inversion. It is known from FIG. 10 that as the scan lines are driven through the two-line inversion, the reset data $RD_1$ is arranged between the image section $DS_2$ and the image section $DS_3$, and the reset data $RD_2$ is arranged subsequent to image section $DS_4$. As the arrangement of the reset data RD of the second embodiment is different from that of the first embodiment, the waveform of the output enable signal OE of the second embodiment is also different from that of the first embodiment.

Figure 11A:
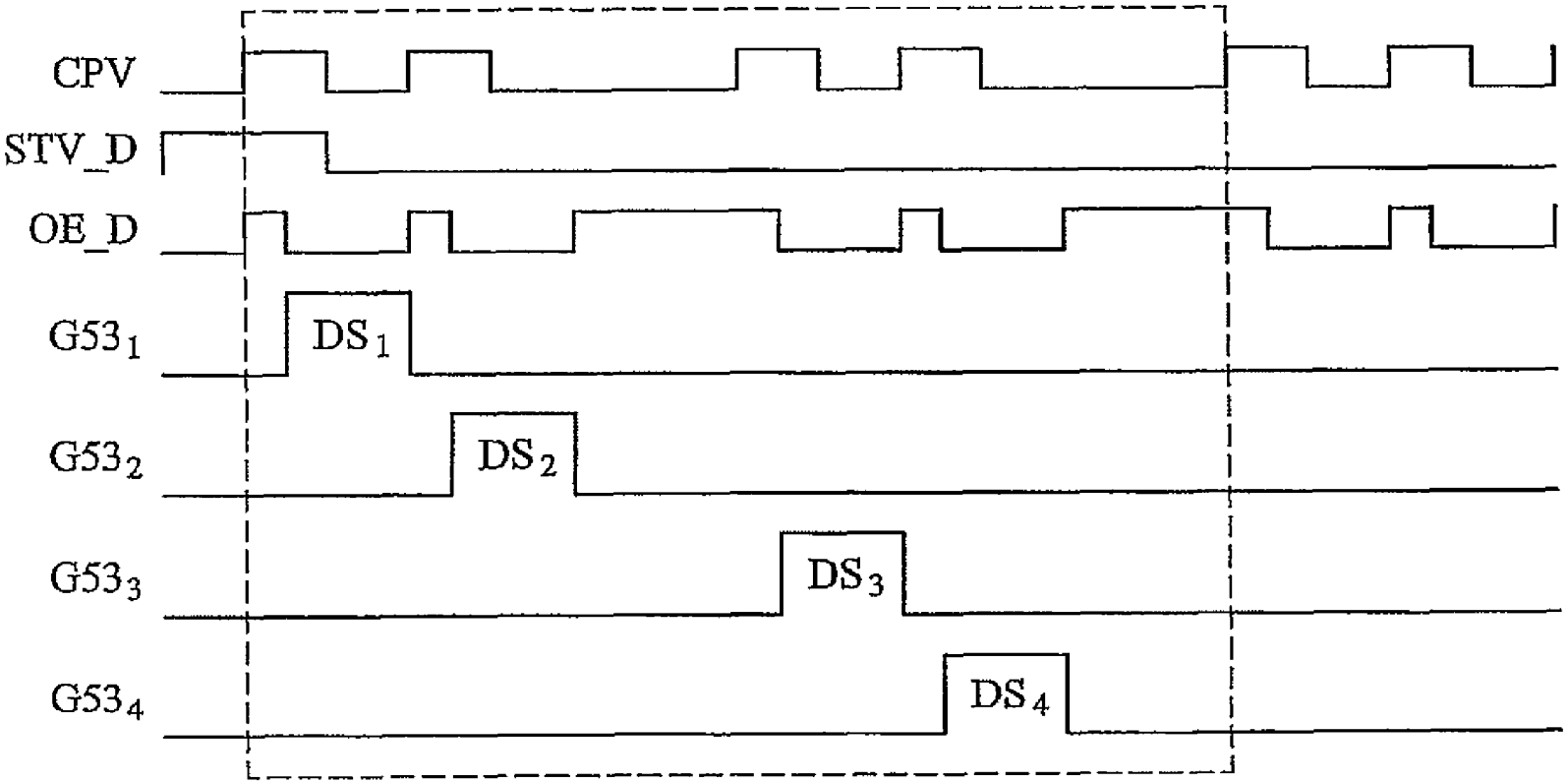
FIGS. 11*a* and 11*b* are timing diagrams of the display device according to the second embodiment of the present invention.
Figure 11B:
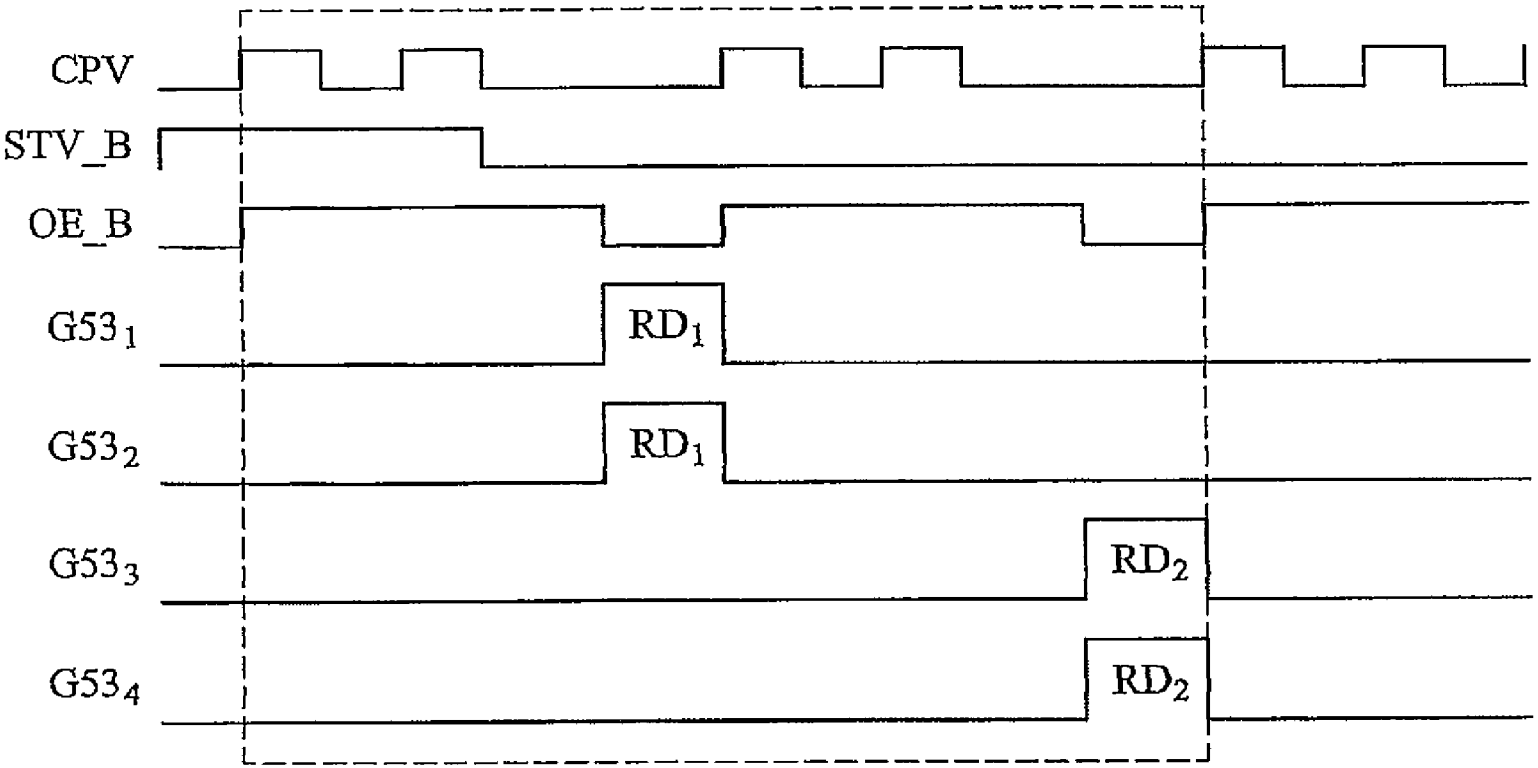

FIGS. 11*a* and 11*b* are timing diagrams of the display device according to the second embodiment of the present invention. The scan lines are driven through the two-line inversion in the second embodiment, so the waveform of the vertical start signal STV of the second embodiment is different from that of the first embodiment.

Referring to FIG. 11*a*, when the vertical start signal STV exhibits the image section start waveform STV_D, the driving unit 53 sequentially drives the scan lines $G53_1$-$G53_4$ according to the image section start waveform STV_D. Then, the driving units 54 and 56 perform the same driving of the scan lines. When the scan lines $G53_1$-$G53_4$ are driven, the driving unit 53 allows the display units on the scan lines $G53_1$-$G53_4$ of the group P1 to receive the corresponding image sections $DS_1$-$DS_4$ respectively according to the low level of the gate timing signal CPV and the image section enable waveform OE_D.

Referring to FIG. 11*b*, when the vertical start signal STV has the reset data start waveform STV_B, the driving unit 53 drives the scan lines $G53_1$ and $G53_2$ (the scan lines of the first portion of the group P1) at the same time according to the reset data start waveform STV_B, and then drives the scan lines $G53_3$ and $G53_4$ (the scan lines of the second portion of the group P1) at the same time. After the driving unit 53 drives the scan lines $G53_1$-$G53_4$, the driving units 54 and 56 perform the same driving of the scan lines. When the scan line $G53_1$ and $G53_2$ are driven, the driving unit 53 allows the display units on the scan lines $G53_1$ and $G53_2$ of the group P1 to receive the reset data $RD_1$ at the same time according to a first low level of the reset data enable waveform OE_B. Then, when the scan line $G53_3$ and $G53_4$ are driven, the driving unit 53 allows the display units on the scan lines $G53_3$ and $G53_4$ of the group P1 to receive the reset data $RD_2$ at the same time according to a second low level of the reset data enable waveform OE_B.

Figure 12:
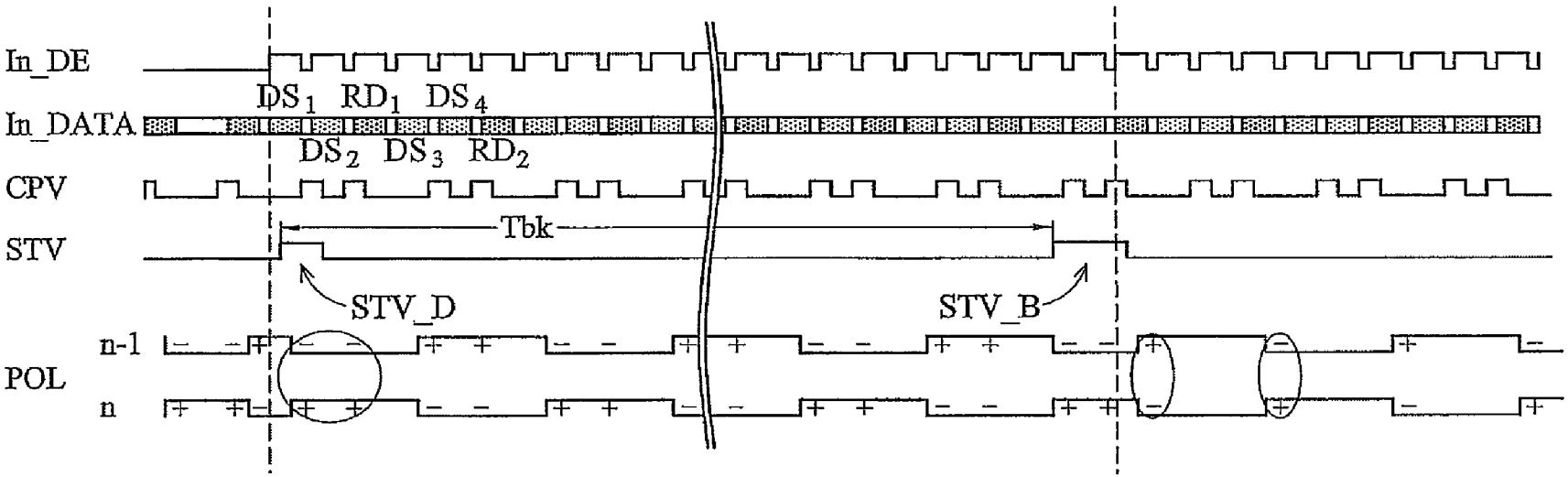
FIG. 12 is a schematic view illustrating polarities of the data according to the second embodiment of the present invention.

FIG. 12 is a schematic view of the polarities of the data of the second embodiment of the present invention. In the $(N-1)^{th}$ frame, the polarities POL of the image sections are "−−++ . . . " in a sequence. In the $N^{th}$ frame, when the image section start waveform STV_D of the vertical start signal STV appears, the polarities POL of the image sections are sequentially changed to "++−− . . . ". Similarly, referring to FIG. 12, in the $N^{th}$ frame, the polarities POL of the reset data image sections are "+−+− . . . " sequentially. In the $N^{th}$ frame, when the reset data start waveform STV_B of the vertical start signal STV appears, the polarities POL of the reset data are changed to "−+−+ . . . " sequentially.

It will be apparent to persons of ordinary art in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display device, comprising:

a plurality of data lines;

a plurality of scan lines, interlaced with the data lines;

a display array, having a plurality of display units, wherein each of the display units corresponds to a set of a data line and a scan line interlaced with the data line;

a data driver, for controlling the data lines and outputting an image signal, wherein the image signal has a plurality of image sections and the image sections correspond to the scan lines; and a scan driver, for driving the scan lines;

wherein a predetermined number of the image sections are defined as a group, each group of the image sections has a first and a second reset data, and each group of the scan lines is classified into a first portion and a second portion;

wherein the scan driver sequentially drives a first group of the scan lines according to a first start waveform, and the data driver writes the first group of the image sections into the display units on the scan lines of the first group respectively through the data lines; and wherein the scan driver drives the first group of scan lines according to a second start waveform after a predetermined period, and the data driver writes the first reset data into the display units on the scan lines of the first portion and writes the second reset data into the display units on the scan lines of the second portion through the data lines.

2. The display device as claimed in claim 1, wherein the scan driver controls the scan lines according to at least a gate timing signal, a vertical start signal, and at least an output enable signal.

3. The display device as claimed in claim 2, wherein the first start waveform is an image section start waveform of the vertical start signal, the second start waveform is a reset data start waveform of the vertical start signal, and the reset data start waveform is subsequent to the image section start waveform after the predetermined period.

4. The display device as claimed in claim 1, wherein polarities of the image sections are changed according to the first start waveform.

5. The display device as claimed in claim 1, wherein polarities of the first reset data and the second reset data are changed according to the second start waveform.

6. The display device as claimed in claim 1, wherein the first and the second reset data are image data of any single grayscale.

7. The display device as claimed in claim 6, wherein the image data of the single grayscale displays an all-white frame or an all-black frame.

8. The display device as claimed in claim 1, wherein the scan driver at least comprises:

a first scan unit, for controlling the first group of scan lines and receiving a first output enable signal for allowing the display units on the scan lines of the first group to receive the first group of image sections or to receive the first reset data and the second reset data; and a second scan unit, for controlling the second group of scan lines and receiving a second output enable signal for allowing the display units on the scan lines of the second group to receive the second group of image sections or to receive the first reset data and the second reset data, wherein the first output enable signal and the second output enable signal are independent from each other.

9. The display device as claimed in claim 8, wherein the first scan unit allows the display units on the scan lines of the first group to receive the first group of image sections according to an image section enable waveform of the first output enable signal, and the second scan unit allows the display units on the scan lines of the second group to receive the second group of image sections according to an image section enable waveform of the second output enable signal.

10. The display device as claimed in claim 9, wherein the image section enable waveform of the first output enable signal and the image section enable waveform of the second output enable signal are partially overlapped in time.

11. The display device as claimed in claim 8, wherein the first scan unit allows the display units on the scan lines of the first group to receive the first group of first reset data and second reset data according to a reset data enable waveform of the first output enable signal, and the second scan unit allows the display units on the scan lines of the second group to receive the second group of first reset data and second reset data according to a reset data enable waveform of the second output enable signal.

12. The display device as claimed in claim 1, wherein the data driver writes the first reset data into the display units on the scan lines of the first portion at the same time through the data lines.

13. The display device as claimed in claim 11, wherein the data driver writes the second reset data into the display units on the scan lines of the second portion at the same time.

14. The display device as claimed in claim 1, further comprising:

a receiving unit, for receiving a data enable signal, an input image signal, and a clock signal from an external device;

an operating unit, coupled to the receiving unit for generating the first and the second reset data according to the data enable signal, the input image signal, and the clock signal;

a data rearrangement unit, coupled to the receiving unit and the operating unit, for receiving the data enable signal, the input image signal, the clock signal, the first reset data, and the second reset data, and rearranging the input image signal, the first reset data, and the second reset data to generate the image signal; and a timing generation unit, receiving the image signal, for generating the first and the second start waveforms according to the image signal, transmitting the image signal to the data driver, and transmitting the first and the second start waveforms to the scan driver.

15. The display device as claimed in claim 14, wherein the data rearrangement unit divides the input image signal into the image sections, defines each predetermined number of the image sections as the group, and inserts the first and second reset data into the group.

16. The display device as claimed in claim 14, wherein the image data is delayed compared to the input image data.

17. The display device as claimed in claim 14, wherein the timing generation unit further generates a plurality of control signals into the scan driver according to the image data.

18. The display device as claimed in claim 17, wherein the control signals at least comprise a gate timing signal, a vertical start signal, and at least an output enable signal.

19. A driving method, for a display device, wherein the display device comprises a plurality of data lines, a plurality of scan lines, and a plurality of display units corresponding to the data lines and scan lines interlaced with the data lines, the driving method comprising:

receiving an image input signal;

dividing the image input signal into a plurality of image sections corresponding to the scan lines;

defining each predetermined number of the image sections as a group;

dividing each group of scan lines into a first portion and a second portion;

inserting a first reset data and a second reset data in each group of the image sections to generate an image data;

sequentially driving a first group of scan lines according to a first start waveform;

writing the image sections into the display units on the scan lines of the first group respectively through the data lines;

driving the scan lines of the first group according to a second start waveform;

writing the first reset data into the display units on the scan lines of the first portion through the data lines; and writing the second reset data into the display units on the scan lines of the second portion through the data lines.

20. The driving method as claimed in claim 19, wherein the steps of driving the scan lines of the first group further comprise driving the first group of scan lines according to a gate timing signal, a vertical start signal, and at least an output enable signal.

21. The driving method as claimed in claim 20, wherein the first start waveform is an image section start waveform of the vertical start signal, the second start waveform is a reset data start waveform of the vertical start signal, and the reset data start waveform is subsequent to the image section start waveform after a predetermined period.

22. The driving method as claimed in claim 19, wherein polarities of the image sections are changed according to the first start waveform.

23. The driving method as claimed in claim 19, wherein polarities of the first and the second reset data are changed according to the second start waveform.

24. The driving method as claimed in claim 19, wherein the first and the second reset data are image data of any single grayscale.

25. The driving method as claimed in claim 24, wherein the single grayscale displays an all-white frame or an all-black frame.

26. The driving method as claimed in claim 19, further comprising:

allowing to write the first group of image sections or write the first and the second reset data into the display units on the scan lines of the first group according to a first output enable signal; and allowing to write the second group of image sections or write the first and the second reset data into the display units on the scan lines of the second group according to a second output enable signal, wherein the first and the second output enable signals are independent from each other.

27. The driving method as claimed in claim 26, further comprising:

allowing to write the first group of image sections into the display units on the scan lines of the first group according to the image section enable waveform of the first output enable signal; and allowing to write the second group of image sections into the display units on the scan lines of the second group according to the image section enable waveform of the second output enable signal.

28. The driving method as claimed in claim 27, wherein the image section enable waveform of the first output enable signal and the image section enable waveform of the second output enable signal are partially overlapped in time.

29. The driving method as claimed in claim 26, further comprising:

allowing to write the first group of first and the second reset data into the display units on the scan lines of the first group according to the reset data enable waveform of the first output enable signal; and allowing to write the second group of first and the second reset data into the display units on the scan lines of the second group according to the reset data enable waveform of the second output enable signal.

30. The driving method as claimed in claim 19, wherein the step of writing the first reset data comprises writing the first reset data into the display units on the scan lines of the first portion at the same time.

31. The driving method as claimed in claim 30, wherein the step of writing the second reset data comprises writing the second reset data into the display units on the scan lines of the second portion at the same time.

32. The driving method as claimed in claim 19, further comprising:

generating the first and the second reset data according to the input image signal, a data enable signal, and a clock signal;

inserting the first and the second reset data in each group of image sections, and delaying the input image data to generate the image signal; and generating the first and the second start waveforms according to the image signal.

* * * * *